US006931814B2

(12) United States Patent
Henits

(10) Patent No.: US 6,931,814 B2
(45) Date of Patent: Aug. 23, 2005

(54) DEVICES FOR POSITIONING AND TAPERING THE EDGES OF ADJACENT WALLBOARDS AND METHODS FOR USING SAME

(76) Inventor: Stephen A. Henits, 153 Howell Ave., Fords, NJ (US) 08863

( * ) Notice: Subject to any disclaimer, the term of this patent is extended or adjusted under 35 U.S.C. 154(b) by 0 days.

(21) Appl. No.: 09/967,522

(22) Filed: Sep. 28, 2001

(65) Prior Publication Data

US 2002/0040561 A1 Apr. 11, 2002

Related U.S. Application Data

(60) Provisional application No. 60/238,256, filed on Oct. 5, 2000.

(51) Int. Cl.[7] ..... E04G 21/165

(52) U.S. Cl. ..... 52/749.1; 81/488; 492/27; 156/348

(58) Field of Search ..... 52/749.1, DIG. 1; 15/230.11; 81/488; 492/27, 13; 30/292, 306, 307, 319; 156/348, 579, 582

(56) References Cited

U.S. PATENT DOCUMENTS

| | | | | |
|---|---|---|---|---|
| 1,638,280 | A | | 8/1927 | Utzman |
| 1,660,834 | A | | 2/1928 | Erola |
| 2,019,095 | A | | 10/1935 | Robinson |
| 2,198,316 | A | | 4/1940 | Richardson |
| 2,318,053 | A | | 5/1943 | Brusse |
| 2,623,557 | A | | 12/1952 | Kendall |
| 2,712,169 | A | | 7/1955 | Buttress |
| 2,871,896 | A | | 2/1959 | Markwell |
| 2,994,899 | A | * | 8/1961 | Moilanen |
| D223,170 | S | * | 3/1972 | Camos |
| 3,762,046 | A | | 10/1973 | Kolomick |
| 3,806,389 | A | | 4/1974 | Gwynne |
| 3,816,199 | A | | 6/1974 | Dawdy et al. |
| 3,925,145 | A | | 12/1975 | Ames |
| 4,196,028 | A | | 4/1980 | Mills et al. |
| 4,197,624 | A | | 4/1980 | Lass |
| 4,208,239 | A | * | 6/1980 | Lass |
| 4,237,669 | A | | 12/1980 | Hunter |
| 4,255,992 | A | | 3/1981 | Bolles |
| 4,406,730 | A | * | 9/1983 | Altmix |
| 4,484,505 | A | | 11/1984 | Lewallyn |
| 4,584,224 | A | | 4/1986 | Schneller |
| 4,587,736 | A | * | 5/1986 | Staffeld ..... 30/292 |
| 4,750,226 | A | * | 6/1988 | Costill |
| 4,809,437 | A | * | 3/1989 | Saliaris |
| 5,069,101 | A | | 12/1991 | Kleemola |
| 5,311,717 | A | | 5/1994 | Yount et al. |
| 5,473,791 | A | * | 12/1995 | Holcomb et al. |
| 5,487,250 | A | | 1/1996 | Yount et al. |
| 5,504,998 | A | * | 4/1996 | Nguyen ..... 30/319 |
| 5,569,285 | A | * | 10/1996 | Webb |
| 5,657,599 | A | | 8/1997 | Peterson et al. |
| 5,720,104 | A | | 2/1998 | Decker |

(Continued)

FOREIGN PATENT DOCUMENTS

| | | |
|---|---|---|
| DE | 19744853 | 2/1999 |
| WO | 9109189 | 6/1991 |

*Primary Examiner*—Robert Canfield

(57) ABSTRACT

An apparatus is disclosed for reshaping a butt joint formed by a pair of adjacent butt edges of mounted wallboards. The apparatus has tapering means, which includes a body with a pair of beveled surfaces for contacting and simultaneously tapering the adjacent butt edges. The apparatus also has aligning means, which includes a ridge for aligning the tapering means with the butt joint. In one embodiment, the apparatus includes a handle and the tapering means is a rotatable wheel attached to one end of the handle and having the ridge and beveled surfaces on its circumferential edge. In another embodiment, the tapering means is a semicircular disk that is fixedly attached to one end of the handle and has an outer curved portion with the ridge and beveled surfaces thereon.

9 Claims, 7 Drawing Sheets

U.S. PATENT DOCUMENTS

D393,987 S * 5/1998 Molo ..... D7/694
5,799,458 A 9/1998 Ferguson
5,832,684 A 11/1998 Trout et al.
5,992,281 A 11/1999 Holbert
6,023,846 A 2/2000 Crawford et al.
6,065,215 A * 5/2000 Arai
6,230,469 B1 5/2001 Santa Cruz et al.
6,540,002 B1 * 4/2003 Edwards et al.
2002/0108342 A1 8/2002 Henits

* cited by examiner

DEVICES FOR POSITIONING AND TAPERING THE EDGES OF ADJACENT WALLBOARDS AND METHODS FOR USING SAME

This is a §111(a) application relating to provisional U.S. application Ser. No. 60/238,256 filed Oct. 5, 2000.

FIELD OF THE INVENTION

The present invention relates to devices for installing and finishing wallboards.

BACKGROUND OF THE INVENTION

Wallboards are commonly used in the construction of buildings to form the interior walls and ceilings of the rooms therein. Wallboard manufacturers recommend leaving a small space between the edges of adjacent wallboards when they are installed onto the framing studs of the buildings. Leaving this recommended space between the wallboards is time-consuming and, furthermore, achieving a space of uniform width is difficult.

After the wallboards are installed onto the framing studs, spackling tape and spackling compound are used, in a well-known and conventional manner, to finish the joints where the edges of adjacent wallboards meet in order to create a flat, smooth surface on the interior walls and ceilings. The flat, smooth surface facilitates application of paint or wallpaper, resulting in an aesthetically appealing finish.

Generally, wallboards are manufactured today having beveled or tapered longitudinal edges and raw, untapered lateral edges, known as butt edges. The longitudinal edges are typically 8, 10, 12, 14 or 16 feet in length, while the lateral edges or butt edges are typically 4 or 4½ feet in length. Where adjacent wallboards are installed having their longitudinal edges properly aligned, then a flat, smooth surface is easily created by the aforementioned application of spackling tape and spackling compound. However, where adjacent wallboards meet at their raw, unshaped butt edges, thereby creating what is referred to as a butt joint, application of the spackling tape and spackling compound will not easily result in a flat, smooth surface. Instead, a ridge or curve results from the use of spackling tape and spackling compound to finish the joint formed by butt edges of adjacent wallboards, or even where the tapered edge of one wallboard is aligned with the butt edge of an adjacent wallboard.

To make the butt joint less noticeable and more aesthetically pleasing to the eye, it must be widened and feathered to an extreme extent, sometimes more than 5 feet in width. Notwithstanding such efforts, a curve remains on the wall or ceiling. For optimum aesthetics, especially when a butt joint is adjacent to a non-perpendicular wall or ceiling, the curve is problematic.

Various devices and methods have been developed to address the problem of finishing joints between raw wallboards edges, such as butt joints. For example, Utzman U.S. Pat. No. 1,638,280 discloses wallboards that are manufactured having pre-shaped beveled edges that will, when the wallboards are installed having the beveled edges adjacent to one another, result in the formation of a recessed joint that can be finished using spackling tape and spackling. This, however, does not aid in the finishing of wallboard joints formed by adjacent raw, untapered wallboard edges.

Utzman also discloses wallboards having covering sheets on the front and rear surfaces thereof and that extend and fold over onto the edges of the wallboards. When these wallboards are installed having their covered edges adjacent to one another, the resulting joint is clean and 1flat. Similarly, Dawdy, et al. U.S. Pat. No. 3,816,199 discloses wallboards having paper coverings on the front surfaces thereof that extend past the wallboard edges, such that when the wallboards are installed and a uniform space is left between the edges, the paper that extends past the edges of the wallboards is tucked into the joint formed therebetween. These methods both, however, require the use of wallboards having paper coverings that extend beyond the surfaces and onto the edges of the wallboards.

Santa Cruz et al. U.S. Pat. No. 6,230,469 discloses a method of creating a recessed joint between wallboards having raw, untapered edges, whereby, prior to mounting the wallboards into the framing stud, longitudinal slots are cut into each raw edge, in between the papered surfaces thereof. Each wallboard is then mounted to the stud in the traditional manner, i.e., using typical wallboard fasteners, such as nails, to fasten the slotted edges to the stud, whereupon the edge is compressed, each slot is closed, and the resulting joint is recessed. Schneller U.S. Pat. No. 4,584,224 also discloses a method of creating a recessed joint between untapered wallboard edges that involves the cutting of a slot into the raw untapered edge of each wallboard prior to mounting the wallboards and then mounting the wallboards with conventional fasteners which compresses the edges, closing the slots and resulting in a recessed joint. These methods have the disadvantage that a cutting tool must be used, the cutting step produces removes a portion of the wallboard material from the edges, thereby producing waste material, and the wallboard edges must be altered prior to mounting the wallboards onto the stud.

Yount et al. U.S. Pat. Nos. 5,311,717 5,487,250 disclose a method of creating a recessed joint between predecorated wallboards, which have a decorated paper covering on their front surfaces and untapered edges. In this method, the wallboards are mounted with their untapered edges adjacent to one another, the decorated paper covering is peeled back to expose the untapered edges and a groove is cut into the adjacent untapered edges, thereby tapering them. A preformed joint strip is then inserted into the resulting recessed joint to fill the groove and the decorated paper of each wallboard is then laid over and adhered to the joint strip. While this method allows the wallboard edges to be reshaped after the wallboards are mounted to the stud, this method requires the use predecorated wallboards as well as an additional part, i.e., a joint strip to fill the joint. In addition, this method requires the use of a cutting tool and results in the removal of a portion of the wallboard material, thereby producing waste.

In addition, there exist a number of devices having wheels that are used apply tape to wallboard joints (see, e.g., Mills et al. U.S. Pat. No. 4,196,028), or to impress and shape tape and mastic into corners formed by adjacent wallboards, thereby finishing such joints and wallboards (see, e.g., Ames U.S. Pat. No. 3,925,145 and Lass U.S. Pat. No. 4,197,624). These devices, however, do not reshape the wallboard edges, but rather, are employed as part of the ultimate finishing operations which occur after the wallboards have been positioned and shaped as appropriate.

The object of the present invention is to provide a novel and economical device and method for the proper orientation of adjacent wallboards to leave a uniform space therebetween and for the creation of a tapered edge on the wallboard's lateral edge or butt edge after installation of the wallboards onto the framing studs.

SUMMARY OF THE INVENTION

The apparatus of the present invention is an apparatus for reshaping a butt joint formed by a pair of adjacent butt edges of mounted wallboards. The apparatus includes tapering means for simultaneously tapering the adjacent butt edges. The tapering means has a first beveled surface sized and shaped so as to contact and reshape one of the butt edges and a second beveled surface sized and shaped so as to contact and reshape the other of the butt edges. The apparatus of the present invention also includes aligning means for aligning said tapering means with the butt joint such that each of said first and second beveled surfaces is automatically aligned with its corresponding butt edge. The aligning means is a ridge that is sized and shaped to fit at least partially into the butt joint and which is intermediate the first and second beveled surfaces. The ridge is substantially V-shaped.

In a first embodiment, the tapering means is a rotatable wheel having a first planar surface on one side of the wheel, a second planar surface on an opposite side of the wheel, and the ridge extending circumferentially about the wheel. The first beveled surface is annularly shaped and extends from the ridge to the first planar surface and the second beveled surface is also annularly shaped and extends from the ridge to the second planar surface. The wheel is rotatably mounted to one end of a handle.

In a second embodiment the tapering means is a semicircular disk having a first planar surface on one side of the disk, a second planar surface on an opposite of the disk, and the ridge extending along an outer curved portion of the disk. The first beveled surface is semicircularly shaped and extends from the ridge to the first planar surface and the second beveled surface is also semicircularly shaped and extends from the ridge to the second planar surface. The disk is non-rotatably mounted to one end of a handle.

In a third embodiment, the tapering means is a bar having a first longitudinal surface on one side of the bar, a second longitudinal surface on an opposite side of the bar, and the ridge extending longitudinally along the bar, intermediate the first and second longitudinal surfaces. The first beveled surface extends from the ridge to the first longitudinal surface and the second beveled surface extends from the ridge to the second longitudinal surface. The ridge is substantially V-shaped. The bar also includes fastening means for fastening the bar to a supporting structure, thereby simultaneously tapering the butt edges. The fastening means is a plurality of holes extending though the bar and a plurality of fasteners, each of which is sized and shaped to be inserted through a corresponding one of the plurality of holes and fastened into the supporting structure.

The present invention also includes a positioning means for positioning adjacent wallboards such that a predetermined space is left between the adjacent butt edges. The positioning means is a spacer bar having a top plate and a lip having a predetermined thickness and extending perpendicularly from said top plate.

The method of the present invention includes the steps of wetting the adjacent butt edges with a wetting agent; inserting the tapering device into the butt joint until the first beveled surface contacts one of the wetted butt edges and the second beveled surface simultaneously contacts the other of the wetted butt edges; and applying pressure to the device such that the first beveled surface reshapes and conforms the first wetted butt edge to its own beveled shape and the second beveled surface simultaneously reshapes and conforms the second wetted butt edge to its own beveled shape.

BRIEF DESCRIPTION OF THE DRAWINGS

For a better understanding of the present invention, reference is made to the following detailed description of various alternative embodiments considered in conjunction with the accompanying drawings, in which.

DESCRIPTION OF THE PREFERRED EMBODIMENT

The present invention utilizes two devices, a tapering device and a spacing device, that are used in conjunction with one another. The following description includes discussions of one embodiment of the spacing device and three embodiments of the tapering device. The spacing device disclosed herein is intended to be used with each of the embodiments of the tapering device.

Figure 1:
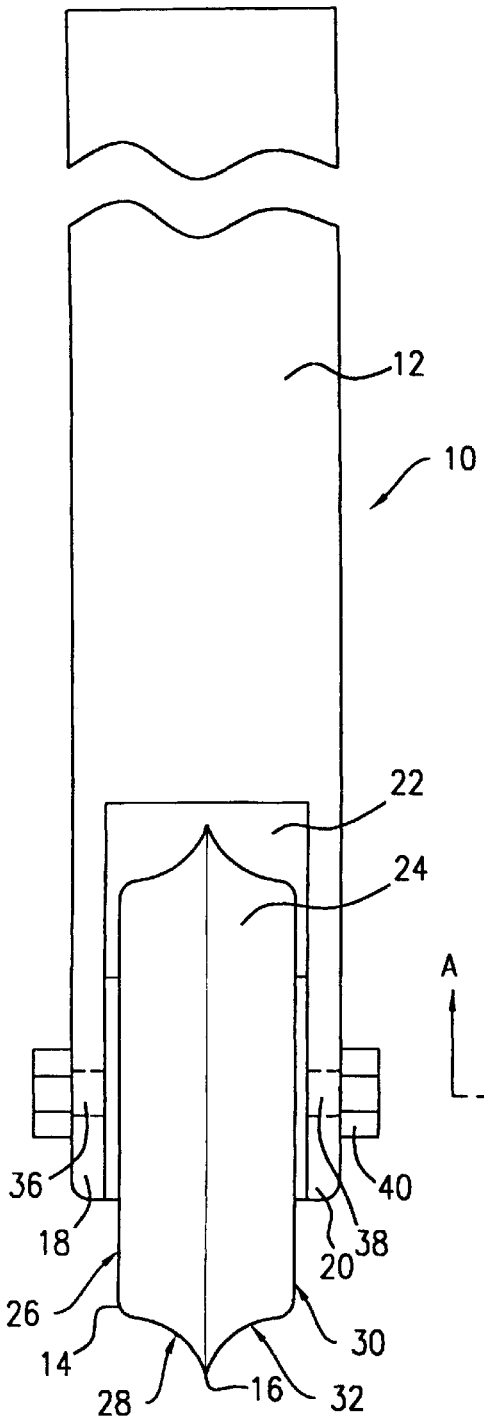
FIG. 1 is a top view of the preferred embodiment of the tapering device of the present invention including a rotatable wheel and a handle, showing the orientation of the wheel in relation to the handle.
Figure 2:
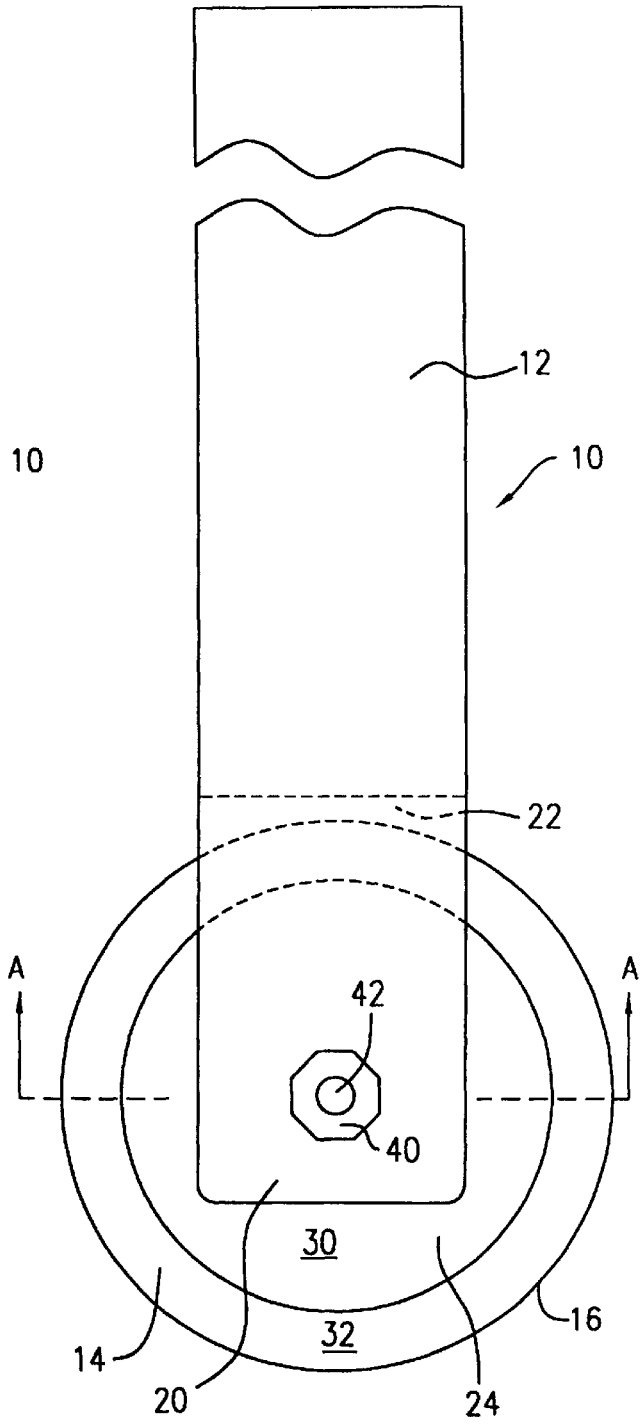
FIG. 2 is a side view of the tapering device of FIG. 1.
Figure 3:
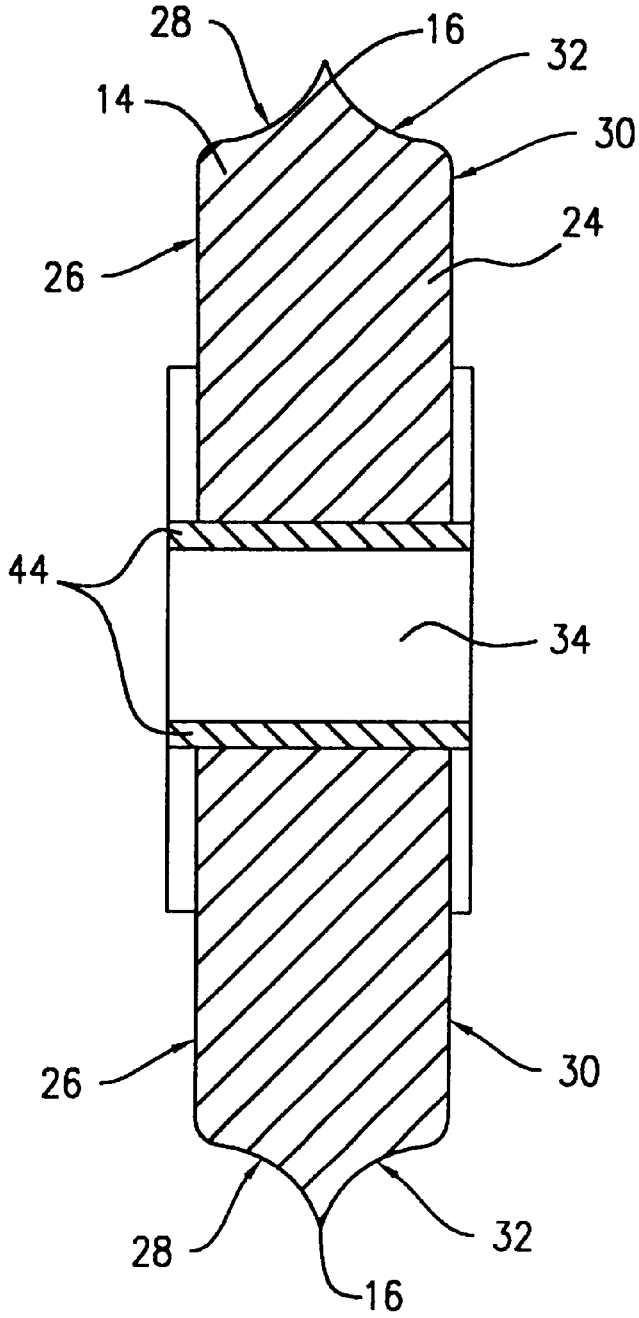
FIG. 3 is a cross-sectional view of the wheel of the tapering device shown in FIG. 2, taken along section line A—A and looking in the direction of the arrows.

Referring to FIGS. 1–3, generally, and to FIGS. 1 and 2, in particular, a preferred embodiment of a tapering device 10 in accordance with the present invention is shown. The tapering device 10 includes a handle 12, tapering means, such as a rotatable wheel 14, and aligning means, such as a ridge 16, which is sized and shaped to fit at least partially into a butt joint, thereby aligning the rotatable wheel 14 with the butt edges of the butt joint. The wheel 14 is rotatably mounted, as described in further detail hereinafter, to one end of the handle 12. The other end of the handle 12 is adapted to be gripped by a user for manipulating the wheel 14.

The handle 12 is generally cylindrical in shape and can made of steel, wood, aluminum or any similar strong, rigid material. Two parallel extensions 18, 20 protrude longitudinally from one end of the handle 12, forming a space 22 therebetween. The space 22 formed by the extensions 18, 20 is sized and shaped to partially receive the wheel 14 therein.

The wheel 14 is suitably made of steel or aluminum or any similar strong, rigid material. More particularly, as can be seen most clearly in FIGS. 1 and 2, the wheel 14 includes a body 24 having a first planar surface 26 and a first beveled surface 28 on one side thereof and a second planar surface 30 and a second beveled surface 32 on an opposite side thereof. The ridge 16 is preferably substantially V-shaped and extends circumferentially about the wheel 14 intermediate the beveled surfaces 28, 32 which are annularly-shaped. More particularly, the first beveled surface 28 extends from the ridge 16 to the first planar surface 26 of the wheel 14 and the second beveled surface 32 extends, on the opposite side of the ridge 16, from the ridge 16 to the second planar surface 30. As can be seen in FIG. 1, each of the first and second beveled surfaces 28, 32 has a concave curvature from the ridge 16 to the vicinity of the planar surface 26, 30. The shape of the curvature is parabola-like (i.e., the radius of curvature of each of the beveled surfaces 28, 32 increases from points on the beveled surface 28, 32 that are near the ridge 16 to points on the beveled surface 28, 32 that are further from the ridge 16). The first and second beveled surfaces 28, 32 are each sized and shaped so as to simultaneously contact and reshape the butt edges of a butt joint, as will be described hereinafter.

As can be seen most clearly in FIG. 3, the wheel 14 also has an axial hole 34 therethrough which aligns with similarly sized holes 36, 38 (shown in phantom in FIG. 1) in each of the extensions 18, 20 of the handle 12. The wheel 14 is rotatably mounted on the handle 12 with suitable conventional attaching means, such as a nut 40 and a bolt 42 that is inserted through the aligned holes 34, 36, 38 of the wheel 14 and the extensions 18, 20. With particular reference to FIG. 3, a bushing 44, made of bronze or a similar suitable material, that is sized and shaped to fit within the axial hole 34 of the wheel 14, facilitates rotation of the wheel 14. When the wheel 14 and handle 12 are assembled as described above, the wheel 14 extends out from the space 22 between the extensions 18, 20 and rotates easily about its axis, for a purpose to be described hereinafter.

Figure 4:
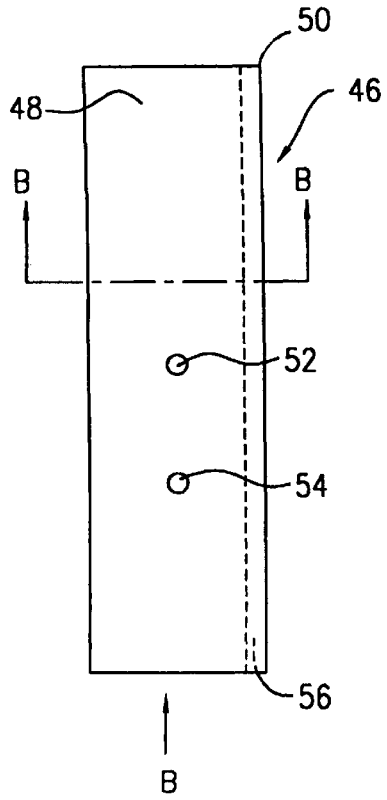
FIG. 4 is a top plan view of a spacer bar in accordance with the present invention and which is used in conjunction with the tapering device of FIG. 1.
Figure 5:
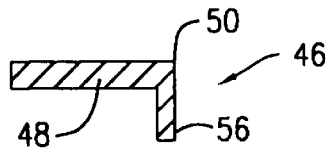
FIG. 5 is a cross-sectional view of the spacer bar of FIG. 4, taken along section line B—B and looking in the direction of the arrows.

With reference now to FIGS. 4 and 5, positioning means, such as a spacer bar 46, is used in conjunction with the tapering device 10 of the present 5 invention. The spacer bar 46 includes a top plate 48 having a longitudinal side 50 of approximately four inches in length. The top plate 48 is provided with a pair of guide holes 52, 54, for a purpose to be described hereinafter. The spacer bar 46 also includes a short lip 56 that extends perpendicularly from the longitudinal side 50 and suitably has a width of approximately ⅛ of an inch. The purpose of the lip 56 will also be described hereinafter.

Figure 6:
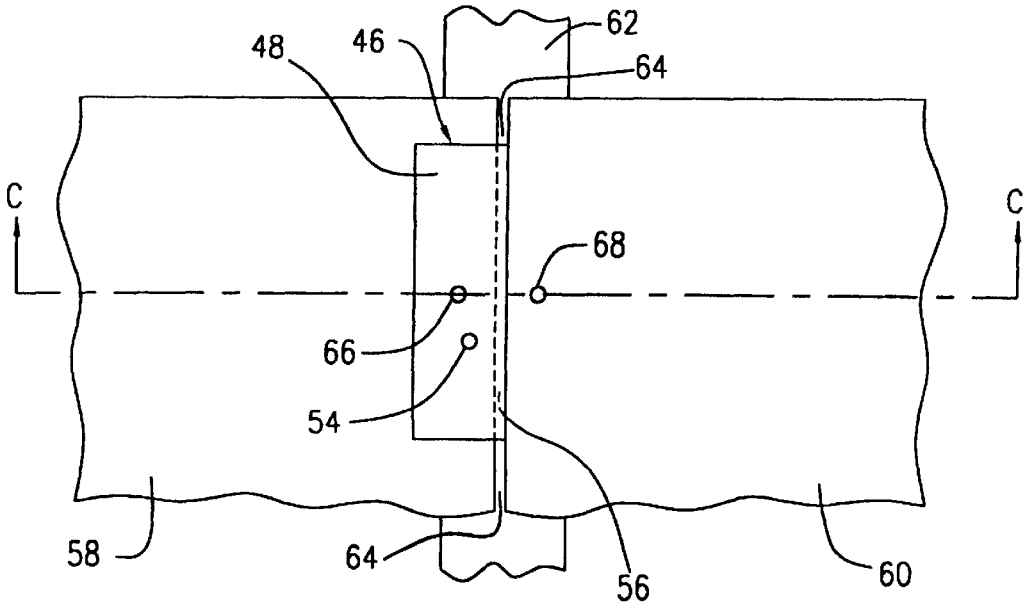
FIG. 6 is a schematic depiction of how the spacer bar is used to arrange wallboards for installation onto a framing stud and showing the space or gap between the aligned butt edges of adjacent wallboards.

The operation of the spacer bar 46 will now be discussed. Referring specifically to FIG. 6, adjacent wallboards 58, 60 are first installed onto a framing stud 62, which may be made of wood or steel. The wallboards 58, 60 are installed by permanently affixing them to the framing stud 62 by conventional means such as stud screws 66, 68 (see, for instance, FIGS. 7 and 8). The wallboard manufacturers recommend leaving a space 64 between the edges of adjacent wallboards 58, 60 of up to about ⅛ of an inch. The space 64 is recommended to allow for the movement of the adjacent wallboards 58, 60 because the framing studs expand and contract due to temperature and humidity but the wallboards do not. In addition, wooden framing studs used on new homes will shrink as they age due to their completed drying over time. Without the space 64, during the contraction of the framing stud 62, especially those made of wood, the wallboards 58, 60 will compress along their aligned edges, i.e., their weakest point, forming a raised ridge. This phenomenon is known as ridging. Although the wallboard manufacturers recommend installing the wallboards 58, 60 with a space 64 between them, leaving the space 64 during installation is time consuming and, therefore, the recommendation is most often ignored and no space is left.

Referring still to FIG. 6, the spacer bar 46 is used to facilitate leaving the proper space 64 between adjacent wallboards 58, 60 during their installation onto the framing stud 62. As shown in FIG. 6, prior to affixing the wallboards 58, 60 to the framing stud 62, the spacer bar 46 is positioned along the aligned edges of the adjacent wallboards 58, 60 such that its top plate 48 rests upon one of the wall boards 58 and its lip 56 is received in between the adjacent wall boards 58, 60. The edge of the other wall board 60 contacts the lip 56 of the spacer bar 46, thereby ensuring that the space 64 between the wallboards 58, 60 is equal to the width of the lip 56, i.e., approximately ⅛ of an inch. The guide holes 52, 54 on the top plate 48 of the spacer bar 46 (see FIG. 4) are used to locate the proper places for the stud screws 66, 68 (see FIG. 6). One hole 52 is used to locate the proper position for stud screws 66, 68 for wooden framing studs and the other hole 54 is used to locate the proper position for stud screws (not screws) for steel framing studs.

Figure 7:
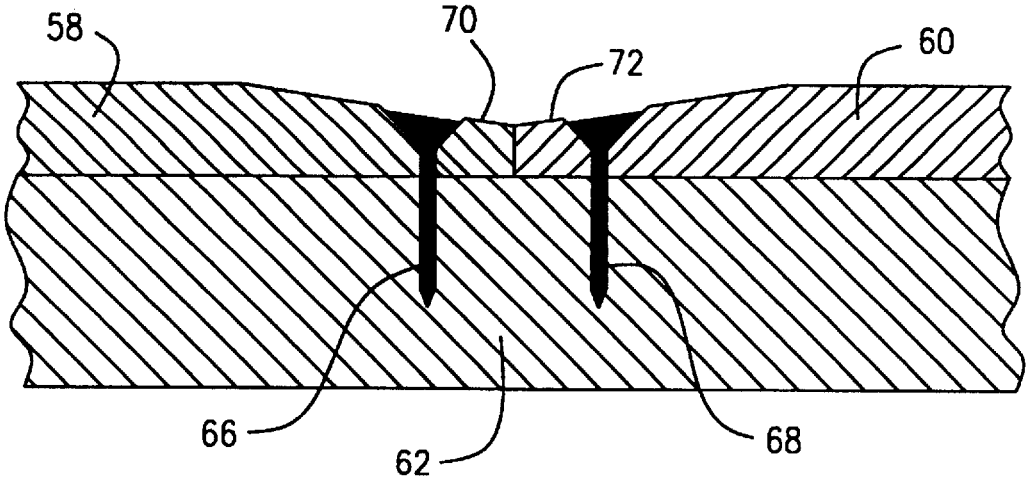
FIG. 7 is a schematic cross-section of adjacent wallboards and a framing stud, similar to those of FIG. 6, but the aligned edges of the wallboards are tapered longitudinal edges, having no space therebetween, and the stud is aligned transversely to the direction of the tapered longitudinal edges.
Figure 8:
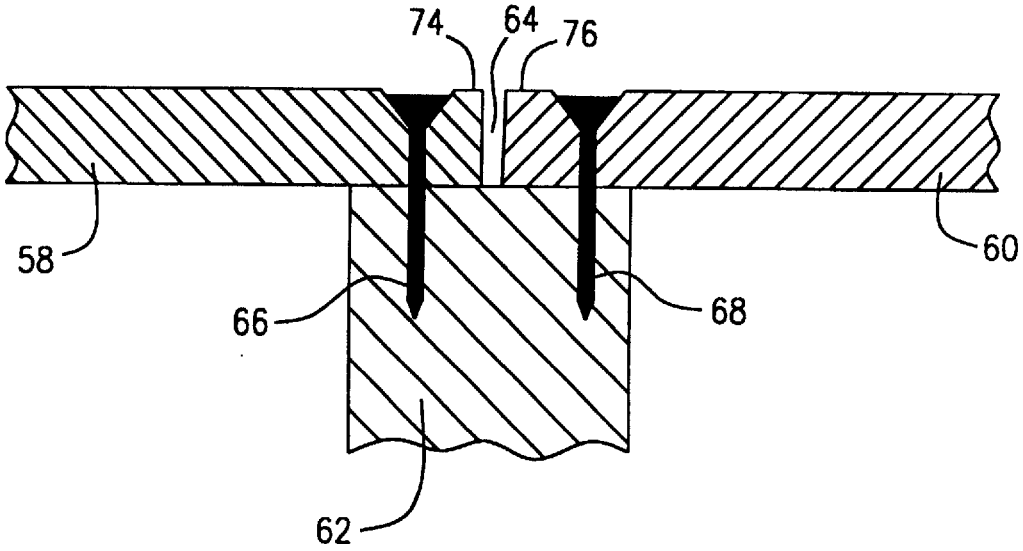
FIG. 8 is a schematic cross-section of the adjacent wallboards and framing stud of FIG. 6, taken along section line C—C and looking in the direction of the arrows, showing the wallboards aligned along their butt edges.

With reference now to FIGS. 7 and 8, wallboards are typically manufactured having tapered longitudinal edges 70, 72 (see FIG. 7) and shorter lateral edges, known as butt edges 74, 76 (see FIG. 8), which are untapered. Where the adjacent wallboards 58, 60 are aligned along their tapered longitudinal edges 70, 72 as shown in FIG. 7, the joint, created by the tapered longitudinal edges 70, 72 can be filled with spackling tape and spackling compound to form a flat, smooth surface, without leaving the recommended space or using the either the spacer bar or roller device of the present invention. As can be seen in FIG. 7, the framing stud 62 is aligned transversely to the tapered longitudinal edges 70, 72.

Where, however, the adjacent wallboards 58, 60 are aligned along their butt edges 74, 76, as shown in FIG. 8, the spacer bar and tapering device of the present invention are both used, as will be described hereinafter, to create the proper space 64 between the adjacent wallboards 58, 60 and to taper the butt edges 74, 76 prior to the application of spackling tape and spackling compound. Use of the guide holes 52, 54 on the spacer bar 46 to properly position the stud screws 66, 68 ensures that the studs screws 66, 68 will not interfere with the tapering of the butt edges 74, 76.

After the adjacent wallboards 58, 60 are properly spaced and installed onto the framing stud 62 with their butt edges 74, 76 aligned, the tapering device 10 of the present invention is used to taper the butt edges 74, 76 in preparation for finishing with spackling tape and spackling compound. As a general matter, when a wallboard is to be shaped, such as when it is to be installed around a curve or ceiling or when it is to be molded or deformed as is described herein, water or other liquid is often used to soften the wallboard in preparation for the shaping process. Once the wallboard is shaped and allowed to dry, the wallboard will retain the shape or curvature. With this principle in mind, where butt edges 74, 76 of adjacent wallboards 58, 60 are to be tapered by using the tapering device 10, the butt edges 74, 76 are first softened with a suitable wetting agent, such as water or spackling compound.

The method of operating the tapering device 10 to taper the butt edges 74, 76 of adjacent wallboards 58, 60 will now be described. After the wallboards have been positioned and mounted onto the framing stud 62, by either using the spacer bar 46 as described above or by visual estimation, a wetting agent such as water or spackling compound, is applied to the adjacent butt edges 74, 76 of the wallboards 58, 60. A brief pause of about 30 seconds permits the butt edges 74, 76 to absorb the wetting agent and become softened thereby.

Figure 9:
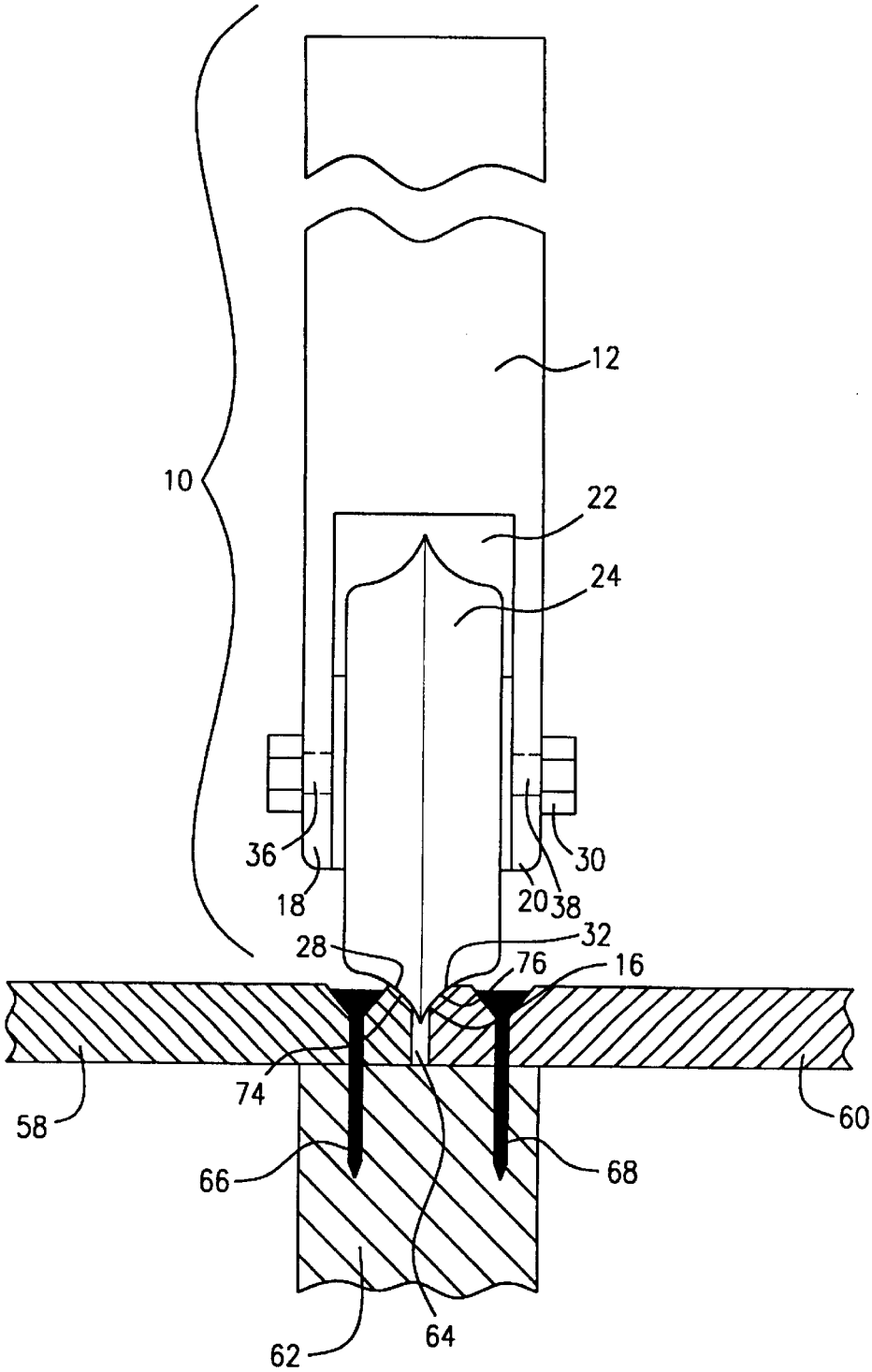
FIG. 9 is a schematic depiction of how the tapering device of FIGS. 1–3 is used to taper the butt edges of the adjacent wallboards shown in FIG. 8.
Figure 10:
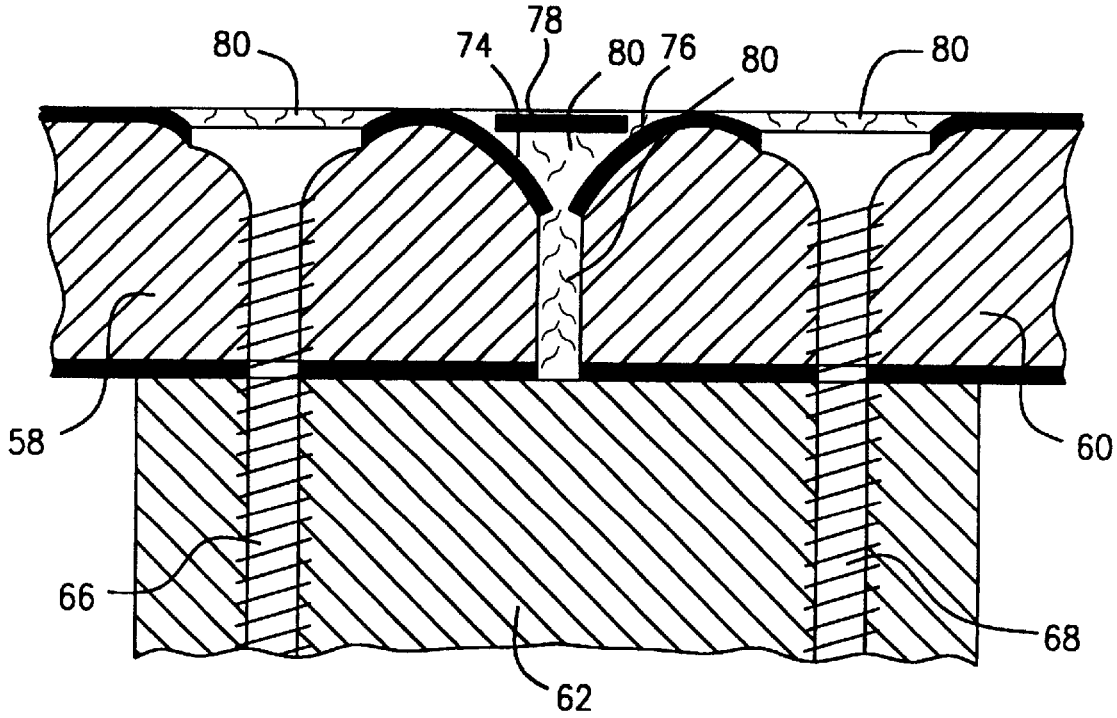
FIG. 10 is a schematic view of the adjacent wallboards and framing stud of FIG. 9, showing the butt edges tapered and their surfaces finished to a flat, smooth surface with spackling tape and spackling compound.

With reference to FIG. 9, the tapering device 10 is then held by its handle 12 and the ridge 16 is inserted, at least partially, into the space 64 between the butt edges 74, 76. Steady pressure is then applied to the wheel 14, via the handle 12 such that the wheel 14 rotates slowly and presses simultaneously against both of the butt edges 74, 76. As shown in FIG. 9, the softened butt edges 64, 66 are tapered by the tapering device 10 under the pressure applied by the handle, shaping the softened butt edges 64, 66 to a curvature that is complementary to the concave curvature of the beveled surfaces 28, 32. As shown in FIG. 10, once the butt edges 74, 76 have been tapered and allowed to dry, spackling tape 78 and spackling compound 80 are applied, in the current conventional manner, to the tapered butt edges 74, 76 and space 64 to form a finished surface that is flat and smooth. The resulting butt joint is very narrow and straight, measuring approximately ¾ of an inch wide.

Normally, the tapered butt edges 74, 76 should be allowed to dry completely before application of the spackling tape 78 and spackling compound 80. If special care is used, however, the first coat of spackling compound 80 can be applied even if the butt edges 74, 76 are not completely dry without negatively effecting the taper of the butt edges 74, 76.

Figure 11:
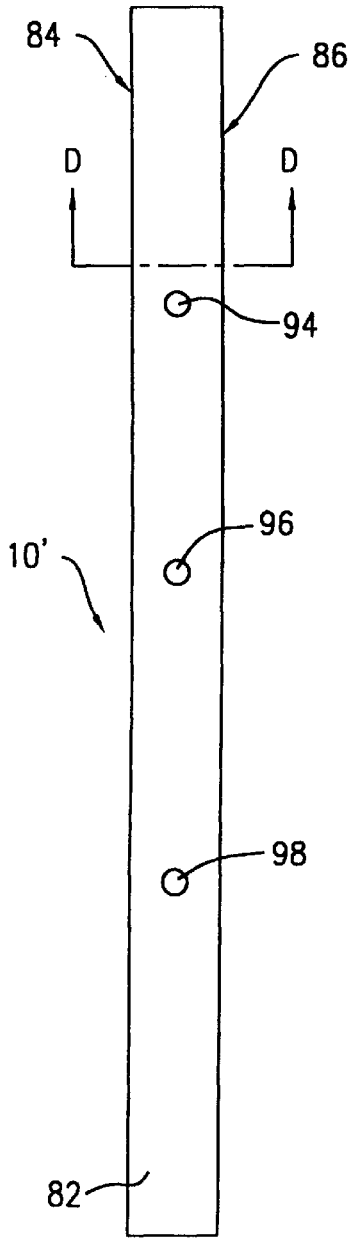
FIG. 11 is a top plan view of an alternative embodiment of the tapering device of the present invention, including a bar having a ridge and a plurality of holes therethrough.
Figure 12:
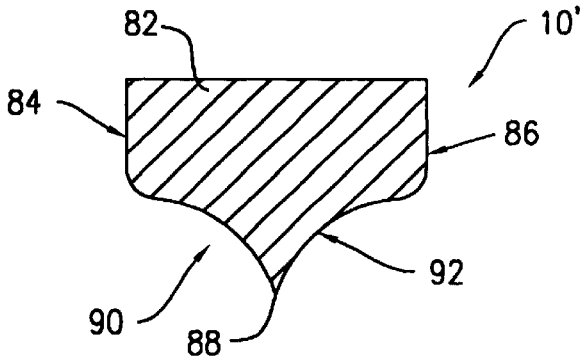
FIG. 12 is a cross-sectional view of the bar of FIG. 11, taken along section line D—D and looking in the direction of the arrows, showing the ridge.

Referring now to FIGS. 11 and 12, an alternative embodiment of the tapering device 10' of present invention includes a bar 82, formed of steel or some similarly strong rigid material, and a plurality of fasteners, such as conventional same-sized screws (not shown). The bar 82 is suitably about twenty two and a half (22½) inches in length and has a first longitudinal surface 84 on one side thereof and a second longitudinal surface 86 on an opposite side thereof. A ridge 88 extends longitudinally along the bar 82, intermediate of the first and second longitudinal surfaces 84, 86. In addition, a first beveled surface 90 extends from the ridge 88 to the first longitudinal surface 84 of the bar 82 and a second beveled surface 92 extends from the ridge 88 to the second longitudinal surface 86 of the bar 82. The ridge 88 is preferably substantially V-shaped and is sized and shaped to fit at least partially into the space 64 between the butt edges 74, 76 that form the butt joint. Each of the first and second beveled surfaces 90, 92 is sized and shaped so as to simultaneously contact and reshape its respective butt edge 74, 76 (see FIG. 8), as is will be described hereinafter.

The bar 82 is provided with fastening means, including a plurality of holes 94, 96, 98 (only some of which are shown) that extend through the bar 82 to the ridge 88. The holes 94, 96, 98 are evenly spaced along the longitudinal length of the bar 82, approximately four inches apart, and each is sized and shaped to receive one of the aforementioned conventional screws therethrough for a purpose to be described hereinafter.

The method of operating the bar 82 to taper the adjacent butt edges 74, 76 will now be described. Referring briefly to FIG. 8, as with the tapering device 10 described above, water or spackling compound is first applied to the butt edges 74, 76 of the adjacent wallboards 58, 60 to soften them. The bar 82 is then placed along the space 64 between the butt edges 74, 76, with the tapered ridge 88 aligned with the space 64 and the first and second beveled surfaces 90, 92 each contacting a respective butt edge 74, 76. One of the conventional screws (not shown) is then inserted through each of the holes 94, 96, 98 and screwed into the framing stud 62. As the screws (not shown) are further screwed into the framing stud 62, they draw the ridge 88 further into the space 64 and the first and second beveled surfaces 90, 92 press more firmly against the butt edges 74, 76 of the adjacent wallboards 58, 60, thereby tapering the butt edges 74, 76 simultaneously. Once the tapering is achieved, the screws are removed from the holes 94, 96, 98 and the bar 82 and ridge 88 are withdrawn from the space 64. After the tapered butt edges 74, 76 have been allowed to dry, spackling tape 78 and spackling compound 80 are applied to the tapered butt edges 74, 76 and space 64 to form a finished surface that is flat and smooth (as shown in FIG. 10). As before, the resulting butt joint is very narrow and straight, measuring suitably approximately ¾ of an inch wide.

Figure 13:
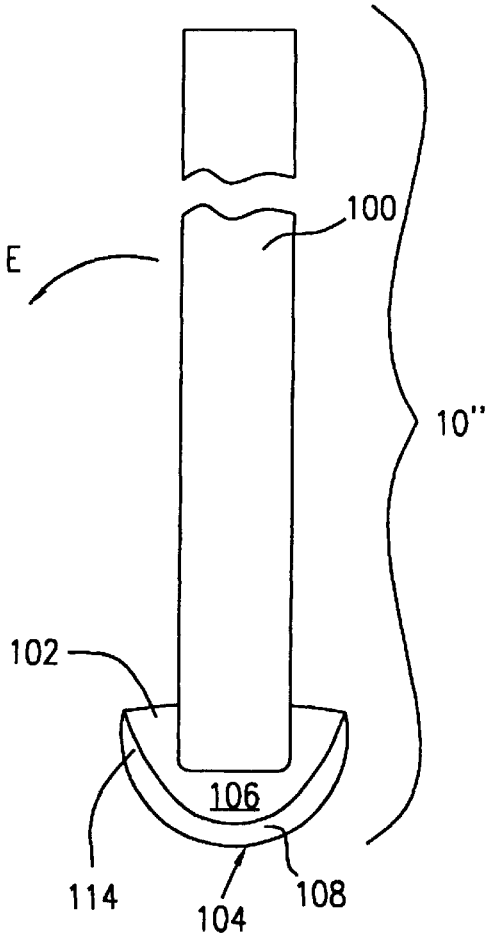
FIG. 13 is a schematic depiction of another alternative embodiment of the present invention where the tapering device includes a semicircular disk and a handle.

Referring now to FIG. 13, a second alternative embodiment of the present invention is a tapering device 10" that includes a handle 100, tapering means, such as a semicircular disk 102, and aligning means, such as a ridge 104, which is sized and shaped to fit at least partially into the butt joint formed by the butt edges 74, 76 (see FIG. 8), thereby aligning the semicircular disk 102 with the butt edges 74, 76. The semicircular disk 102 is non-rotatably mounted to one end of the handle 100. The other end of the handle 100 is adapted to be gripped by a user for manipulating the semicircular disk 102. The handle 100 is generally cylindrical in shape and can made of steel, wood, aluminum or any similar strong, rigid material.

More particularly, still referring to FIG. 13, the semicircular disk 102 includes a first planar surface 106 and a first beveled surface 108 on one side thereof (see FIG. 13) and a second planar surface 110 and a second beveled surface 112 on an opposite side thereof (not specifically shown). The ridge 104 is preferably substantially V-shaped (similar to the ridge 16 of the preferred embodiment shown in FIG. 1) and extends along an outer curved portion 114, intermediate the first and second beveled surfaces 108, 112. More particularly, the first beveled surface 108 extends from the ridge 104 to the first planar surface 106 of the semicircular disk 102 (see FIG. 13) and the second beveled surface 112 extends, on the opposite side of the ridge 104, from the ridge 104 to the second planar surface 110 (not specifically shown). The first and second beveled surfaces 108, 112 are each sized and shaped so as to simultaneously contact and reshape the butt edges 74, 76 of the butt joint, as will be described hereinafter. The semicircular disk 102 is affixed to one end of the handle 100 such that the outer curved portion 114 and the first and second beveled surfaces 108, 112 protrude beyond the handle (see FIG. 13).

The operation of the tapering device 10" of the second alternative embodiment of the present invention will now be described. After moistening the butt edges 74, 76 with water or spackling compound, the tapering device 10" is held by its handle 100, at the end opposite the semicircular disk 102, and the ridge 104 is inserted, at least partially, into the space 64 between the adjacent wallboards 58, 60. The ridge 104 is then pressed firmly and steadily into the space 64, thereby also pressing each of the first and second beveled edges 108, 112 against their respective butt edges 74, 76. The tapering device 10" is then pivoted in the direction indicated by the arrow E in FIG. 13, so that the semicircular disk 102 is also pivoted and the ridge 104 is rolled along the space 58, thereby rolling the first and second beveled surfaces 108, 112 against the butt edges 74, 76 and simultaneously tapering each of the butt edges 74, 76. When the end of the ridge 104 is reached, the semicircular disk 102 is withdrawn from the space 64, reoriented at a point where the butt edges 74, 76 still require tapering, and pressed into the space 64 and butt edges 74, 76, followed by the aforementioned pivoting movement. The aforestated process is repeated along the entire length of the space 64 and the butt edges 74, 76 until the butt edges 74, 76 have been tapered along their entire lengths.

It will be understood that the embodiments described herein are merely exemplary and that a person skilled in the art may make many variations and modifications without departing from the spirit and scope of the present invention. For instance, the use of spackling tape during the spackling step of the process can be eliminated by the use of fiberglass or mono-filament spackling compound in the first two coats. The final coat, however, should be of normal spackle. In addition, other configurations of the device of the present invention, besides the tapering device 10 including a handle 12 and a wheel 14, the tapering device 10' including a bar 82 and a tapering device 10" including a handle 100 and a semicircular disk 102, may be devised by one with ordinary skill in the art.

It should be further noted that the devices and methods of the present invention may applied to butt joints that lie between framing studs, rather than on a framing stud (as shown in FIGS. 6–8). Where the butt joint is formed from butt edges that meet between framing studs, the butt edges of the wallboards should be supported by mounting them, by conventional means, onto a piece of wood, such as a planar sheet of plywood, so as to provide support against the pressure applied thereto by the tapering means of the tapering device 10, 10', 10" of the present invention. All such variations and modifications, including those discussed within the detailed description of the preferred and alternative embodiments, are intended to be included within the scope of the present invention.

I claim:

1. Apparatus for reshaping a butt joint formed by a pair of adjacent butt edges of mounted wallboards, comprising tapering means for simultaneously tapering the adjacent butt edges, said tapering means including a first beveled surface having a concave curvature and being sized and shaped so as to contact and reshape one of the butt edges thereby providing it with a curvature complementary to the concave curvature of said first beveled surface and a second beveled surface having a concave curvature and being sized and shaped so as to contact and reshape the other of the butt edges thereby providing it with a curvature complementary to the concave curvature of said second beveled surface.

2. Apparatus according to claim 1, further comprising aligning means for aligning said tapering means with the butt joint such that each of said first and second beveled surfaces is automatically aligned with its corresponding butt edge.

3. Apparatus according to claim 2, wherein said aligning means includes a ridge sized and shaped to fit at least partially into the butt joint, said ridge being intermediate said first and second beveled surfaces.

4. Apparatus according to claim 3, wherein said ridge is substantially V-shaped.

5. Apparatus according to claim 3, wherein said tapering means includes a body having said first beveled surface on one side thereof, said second beveled surface on an opposite side thereof and said ridge being intermediate said first and second beveled surfaces.

6. Apparatus according to claim 5, wherein said body is a rotatable wheel having a first planar surface on one side of said wheel and a second planar surface on an opposite side of said wheel, said ridge extending circumferentially about said wheel, said first beveled surface being annularly shaped and extending from said ridge to said first planar surface and said second beveled surface being annularly shaped and extending from said ridge to said second planar surface.

7. Apparatus according to claim 6, further comprising a handle having a first end and a second end, said rotatable wheel being rotatably mounted on said first end of said handle and said second end being grippable by a user for the purpose of manipulating said tapering means.

8. Apparatus according to claim 3, wherein said concave curvature of said first beveled surface and said concave curvature of said second beveled surface are parabola-like curvatures.

9. Apparatus according to claim 6, wherein said concave curvature of said first beveled surface has a radius of curvature that increases from points on said first beveled surface that are near said ridge to points on said first beveled surface that are far from said ridge and said concave curvature of said second beveled surface has a radius of curvature that increases from points on said second beveled surface that are near said ridge to points on said second beveled surface that are far from said ridge.

* * * * *